US006328188B1

(12) United States Patent
Boznos et al.

(10) Patent No.: US 6,328,188 B1
(45) Date of Patent: Dec. 11, 2001

(54) ADJUSTABLE LINKAGE FOR A WATCHBAND

(75) Inventors: George S. Boznos, Northbrook, IL (US); Fong Hay Lo, Tai Wai (HK)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 09/627,606

(22) Filed: Jul. 28, 2000

Related U.S. Application Data

(60) Provisional application No. 60/162,829, filed on Nov. 1, 1999.

(51) Int. Cl.[7] ..... A44C 5/00

(52) U.S. Cl. ..... 224/175; 224/164; 224/168; 224/177; 224/180

(58) Field of Search ..... 224/175, 164, 224/167, 168, 174, 177, 179, 180; 59/80, 82; 368/282; 63/9, 4, 5.1, 6, 10; 24/265 WS, 905, 600.7

(56) References Cited

U.S. PATENT DOCUMENTS

| | | | | |
|---|---|---|---|---|
| 1,939,346 | | 12/1933 | Green . | |
| 2,699,035 | | 1/1955 | Becker . | |
| 3,976,233 | | 8/1976 | Cobelli . | |
| 4,414,714 | * | 11/1983 | Kostanecki et al. | 24/265 WS |
| 4,644,611 | * | 2/1987 | Tanaka | 24/600.7 X |
| 4,653,933 | | 3/1987 | Reichel . | |
| 4,689,860 | | 9/1987 | Suchowski . | |
| 4,819,306 | * | 4/1989 | Kasai | 24/600.7 X |
| 5,483,505 | * | 1/1996 | Cartier | 368/282 |
| 5,737,809 | * | 4/1998 | Driver | 24/600.7 |

* cited by examiner

*Primary Examiner*—Stephen K. Cronin
*Assistant Examiner*—Maerena W. Brevard
(74) *Attorney, Agent, or Firm*—Carmody & Torrance LLP

(57) ABSTRACT

A removable link for use in an arrangement comprising a plurality of interlocking links is provided. In a preferred embodiment, the removable link is used in a watchband and preferably comprises a link body having a first end and a second end; a hand portion having a bar receiving region formed at the first end of the body; a retractable retaining pin to having a first end within the link body and a second end extending from the link body into the bar receiving region, the retractable retaining pin being slideable within a bore provided in the link body, the retaining pin for retaining a retainable bar in the bar receiving region; a biasing member, coupled to the retaining pin, for biasing the retaining pin towards the bar receiving region; and a retractor, coupled to the retaining pin, for retracting the retaining pin away from the bar receiving region; whereby the retainable bar is retained within the bar receiving region by the retaining pin, and where the retainable bar is decoupled from the removable link by retracting the retaining pin away from the bar receiving region sufficiently to allow the retainable bar to be removed therefrom.

11 Claims, 4 Drawing Sheets

69
70
72
74
76
77
78
80
81
82
83
84
85
86

ADJUSTABLE LINKAGE FOR A WATCHBAND

RELATED U.S. APPLICATION DATA

This application claims the benefit of U.S. Provisional Application No. 60/162,829, filed Nov. 1, 1999.

BACKGROUND OF THE INVENTION

The present invention relates generally to watchbands, and in particular, to an improved adjustable watchband that provides for removal and insertion of individual links within a watchband without the need of special coupling or decoupling tools.

Generally speaking, the watchband links themselves or the watchband/watchhead casing are connected together by the use bars or springbars, respectively, or other assembly constructions that permit the attachment or detachment of individual links within the watchband, or permit the attachment or detachment of the watchband to the watchhead casing. This enables a wearer to adjust the length of the wristband to accommodate the size of the wearer's wrist, as the length of the desired watchband (i.e. the tightness about one's wrist) will vary from user to user, or from time to time.

Many such attempts to provide for easy coupling and decoupling of links, for watchbands or other devices, are known. For example, U.S. Pat. No. 3,976,233 describes a wristwatch strap and the use of resilient loops in which adjacent link ends may be axially introduced. U.S. Pat. No. 1,939,346 describes the use of a hook $a^2$ and bar $a^3$ arrangement for coupling the links, wherein the use of notches $a^4$ permit the slidability of the bar into corresponding hooks. U.S. Pat. No. 2,699,035 describes yet another example of an ornamental chain for bracelets in which the individual links may be connected or disconnected.

However, the foregoing constructions do not provide the ease with which one may desire to remove individual links while at the same time providing the desired security that the links will not inadvertently become detached.

Accordingly, it is desirable to provide a watchband construction for a wristworn timepiece and/or wrist instrument, such as a watch, that overcomes the above-identified deficiencies and achieves the above and below-identified objectives.

SUMMARY AND OBJECTS OF THE INVENTION

Generally speaking, in accordance with the present invention, a removable link for use in an arrangement comprising a plurality of interlocking links is provided. In a preferred embodiment, the removable link is used in a watchband and preferably comprises a link body having a first end and a second end; a hand portion having a bar receiving region formed at the first end of the body; a retractable retaining pin having a first end within the link body and a second end extending from the link body into the bar receiving region, the retractable retaining pin being slideable within a bore provided in the link body, the retaining pin for retaining a retainable bar in the bar receiving region; a biasing member, coupled to the retaining pin, for biasing the retaining pin towards the bar receiving region; and a retractor, coupled to the retaining pin, for retracting the retaining pin away from the bar receiving region; whereby the retainable bar is retained within the bar receiving region by the retaining pin, and where the retainable bar is decoupled from the removable link by retracting the retaining pin away from the bar receiving region sufficiently to allow the retainable bar to be removed therefrom.

The link body may include integrally formed, spaced apart first and second shoulders which the bar is secured between. The removable link is preferably decoupled from the decoupling link by decoupling the bar of the removable link from a bar retaining region of the decoupling link. The retainable bar may be part of another one of the plurality of interlocking links or may be a springbar coupled between a pair of lugs which themselves are part of a watch casing.

In another preferred embodiment, an arrangement comprising a plurality of interlocking links is provided. Here, the arrangement comprises at least one removable link and at least one decoupling link. The removable link preferably comprises a link body having a first end and a second end; a hand portion having a bar receiving region formed at the first end of the body; a bar coupled to the second end of the body; a retractable retaining pin having a first end within the link body and a second end extending from the link body into the bar receiving region, the retractable retaining pin being slideable within a bore provided in the link body, the retaining pin for retaining a retainable bar in the bar receiving region; a biasing member, coupled to the retaining pin, for biasing the retaining pin towards the bar receiving region; and a retractor, coupled to the retaining pin, for retracting the retaining pin away from the bar receiving region. In a similar manner, the decoupling link comprises a link body having a first end and a second end; a hand portion having a bar receiving region formed at the first end of the body; a retractable retaining pin having a first end within the link body and a second end extending from the link body into the bar receiving region, the retractable retaining pin being slideable within a bore provided in the link body, the retaining pin for retaining the bar of the removable link in its bar receiving region; a biasing member, coupled to the retaining pin, for biasing the retaining pin towards the bar receiving region; and a retractor, coupled to the retaining pin, for retracting the retaining pin away from the bar receiving region. In this construction, the first end of the removable link is decoupled from the arrangement by causing the retainable bar to be decoupled therefrom by retracting the retaining pin thereof away from the bar receiving region sufficiently to allow the retainable bar to be removed therefrom, and further whereby the second end of the removable link is decoupled from the decoupleable link by causing the retracting of the retaining pin of the decoupling link away from the bar receiving region of the decoupling link sufficiently to allow the bar of the removable link to be removed therefrom. This arrangement may include a plurality of removable links and also be part of a watchband, that may also be comprised of other removable links that require a tool for further adjustment, as opposed to the above described removable links, (i.e. no special tool needed for decoupling).

Lastly, a link for releasably coupling a watchhead to a watchstrap is provided. In this embodiment, the link preferably comprises a link body having a first end and a second end, a hand portion having a bar receiving region formed at least at the first end of the body, a retractable retaining pin having a first end within the link body and a second end extending from the link body into the bar receiving region, the retractable retaining pin being slideable within a bore provided in the link body, the retaining pin for retaining a retainable bar in the bar receiving region, a biasing member, coupled to the retaining pin, for biasing the retaining pin towards the bar receiving region; and a retractor, coupled to the retaining pin, for retracting the retaining pin away from the bar receiving region, whereby the second end of the link body may be coupled to an end portion of a watchstrap, and if the retainable bar is a springbar of the watchhead, the link releasably couples the watchstrap to the watchhead or if the second end of the link body is coupled to a springbar of the watchhead and the retainable bar is coupled to an end portion of the watchstrap, the link may also releasably couple the watchstrap to the watchhead.

Accordingly, it is an object of the present invention to provide an improved watchband for a wristwatch that permits easy linking and delinking of individual links within the watchband, all without the need to use a special tool or device therefor.

Another object of the present invention to provide an improved watchband in which the removable link(s) are not visible from the upper surface of the watch (i.e. when on a user's wrist).

Yet another object of the present invention is to provide an improved watchband in which the link configuration conforms to the shape of the existing watchband design.

Still another object of the present invention is to provide an improved watchband in which the removable link(s) have the same function (i.e. movement and integration) as the non-removable links which make up the remaining interlocking links of the watchband.

Yet another object of the present invention is to provide an improved watchband in which the removable link can be removed by hand.

Still another object of the present invention is to provide an improved watchband that can incorporate a plurality of removable links.

Yet another objective of the present invention is to provide an improved interlocking link arrangement that can be utilized for bracelets, necklaces and other devices where adjustability is desired.

In yet another advantage, the present invention can be used so as to interchange various watchheads with the interlocking link arrangement disclosed herein.

Still a further advantage of the present invention is to provide the present invention as an attachment, such as an endpiece, to either the watchhead or the watchstrap, for releasably securing and detaching respective interchangeable straps or watchheads to each other.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

These and other objects and features of the present invention will become clear from the following description taken in conjunction with the preferred embodiments thereof with reference to the accompanying drawing, in which.

Like reference numerals in the figures represent like parts.

DETAILED DESCRIPTION OF THE PREFERRED EMBODIMENTS

Figure 1:
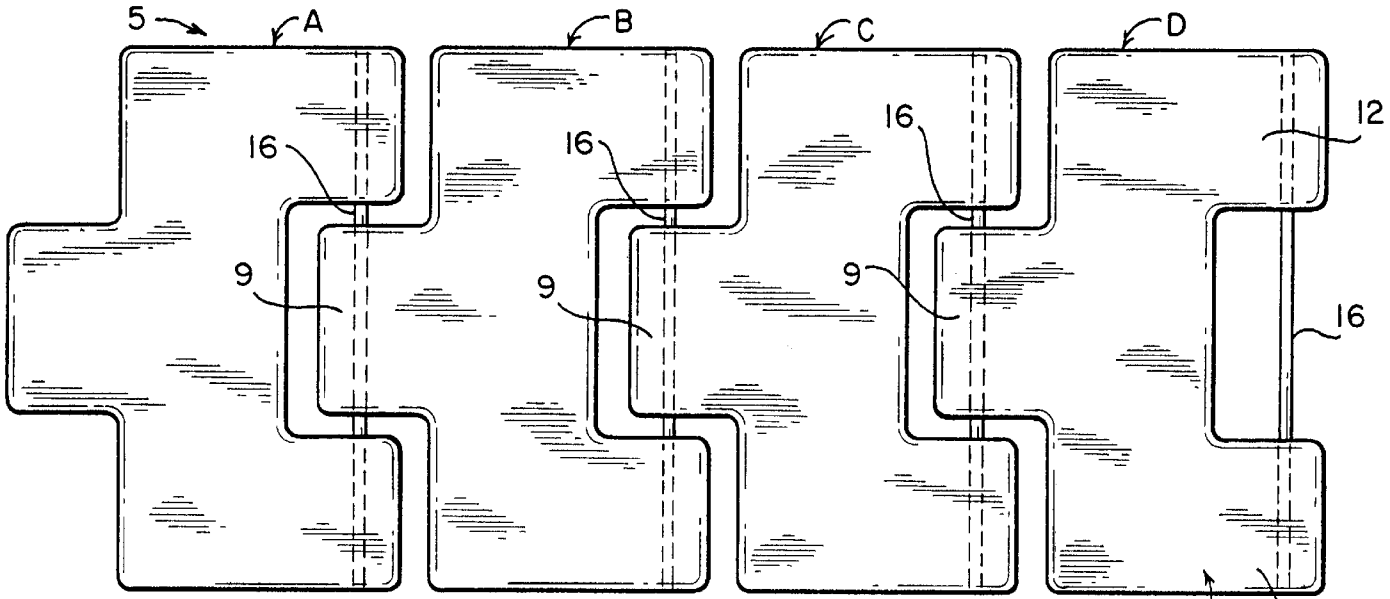
FIG. 1 is a bottom plan view of a plurality of interlocking links constructed for use in a watchband or other interlocking link arrangement constructed in accordance with the present invention.

Reference is first made to FIG. 1, which illustrates a plurality of interlocking links, which, in the preferred embodiment, form part of a watchband, generally indicated at 5, constructed in accordance with the present invention. In particular, illustrated in FIG. 1 are individual links A, B, C and D. Particular reference hereinafter will be made to link D, it being understood that links A, B and C are all preferably constructed similarly. Link D is preferably comprised of a body, generally indicated at 10, having integrally formed shoulders 12, 14 with a bar 16 positioned therebetween. The manner in which bar 16 is fixedly secured within and between shoulders 12, 14 of link 14 is well known in the art. Each bar 16 permits each respectively adjacently coupled link to rotate thereon in a known manner. For example, link C is rotatably coupled to link D, link B is rotatably coupled to link C, etc.

To achieve this coupling, each link A, B, C and D includes a head 9 with an aperture therethrough, though which each respective bar 16 of one adjacent link is rotatably secured. FIG. 1 illustrates the underside of links A, B, C and D, although it should be understood that the top side of links A, B, C and D may appear similar and may include additional ornamentation for aesthetic purposes forming no part of the invention, but discussed in further detail below with reference to FIG. 5. It should be understood that links A–D are preferably constructed not to be removable from watchband 5.

Figure 2:
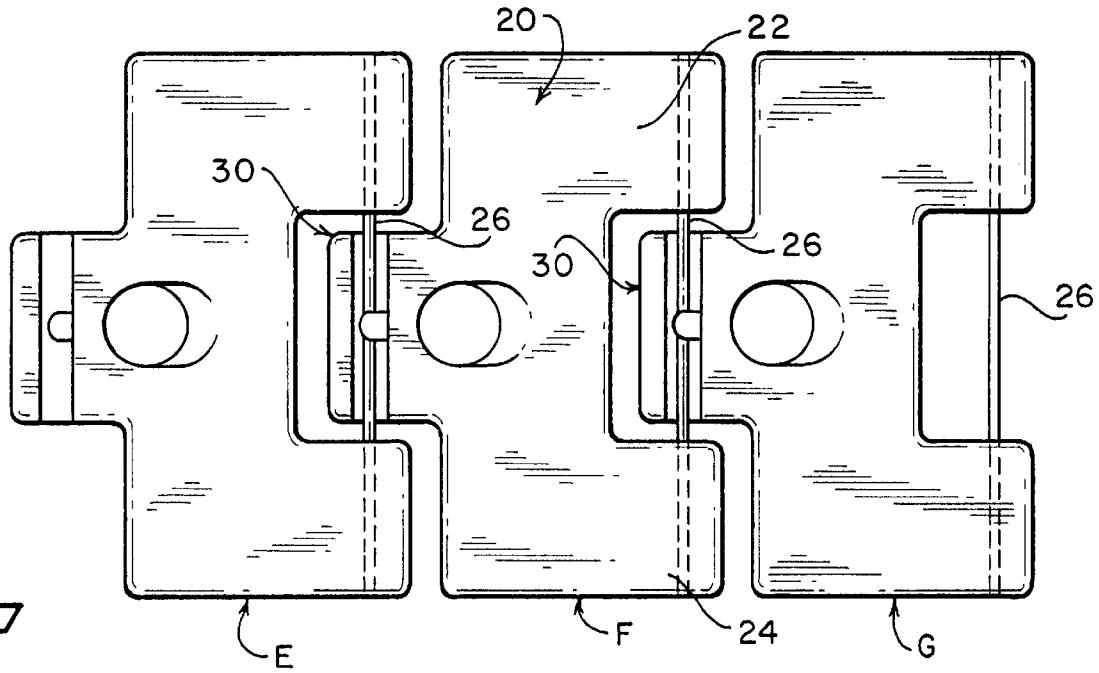
FIG. 2 is a bottom plan view of a plurality of other interlocking links for a watchband or other interlocking link arrangement constructed in accordance with the present invention, at least two of which, coined a "removable link", are constructed in accordance with the present invention, and the third of which, coined a "decouplable link", is also constructed in accordance with the present invention.

Reference is now made to FIG. 2, which illustrates a plurality of additional interlocking links forming a second portion of watchband 5. In particular, illustrated in FIG. 2 are links E, F and G, with particular reference now being made to link F, as it is constructed in accordance with the present invention. Link E is preferably identical to link F. Link G is preferably constructed similarly to link E and F. Hereafter, links E and F shall be coined "removable links" and link G shall be coined a "decoupleable link".

Link F is preferably comprised of a body, generally indicated at 20, having a first end and a second end. At the second end are integrally formed shoulders 22, 24 with a bar 26 positioned therebetween. The manner in which bar 26 is fixedly secured within and between shoulders 22, 24 is in a similar manner to bar 16 of links A–D of FIG. 1. At the first end of link F is a hand portion, generally indicated at 30, which extends from and is preferably integral with body 20. As should be now understood, hand portion 30 of link F is constructed to receive bar 16 of for example, link D and/or a bar 26 of link E. Any bar 16 or any bar 26 shall be coined the "retainable bar" as it is a bar retainable in the hand region. Also deemed a "retainable bar" is a springbar on a watchhead such as that in U.S. Pat. No. 4,653,933, incorporated by reference as if fully set forth herein. In a similar manner, hand portion 30 of link G is constructed to receive therein bar 26 (i.e. the retainable bar) of link F. For completeness, if a second removable link (i.e. link E) is present, it may instead be coupled to link D in the manner disclosed below.

Figure 3:
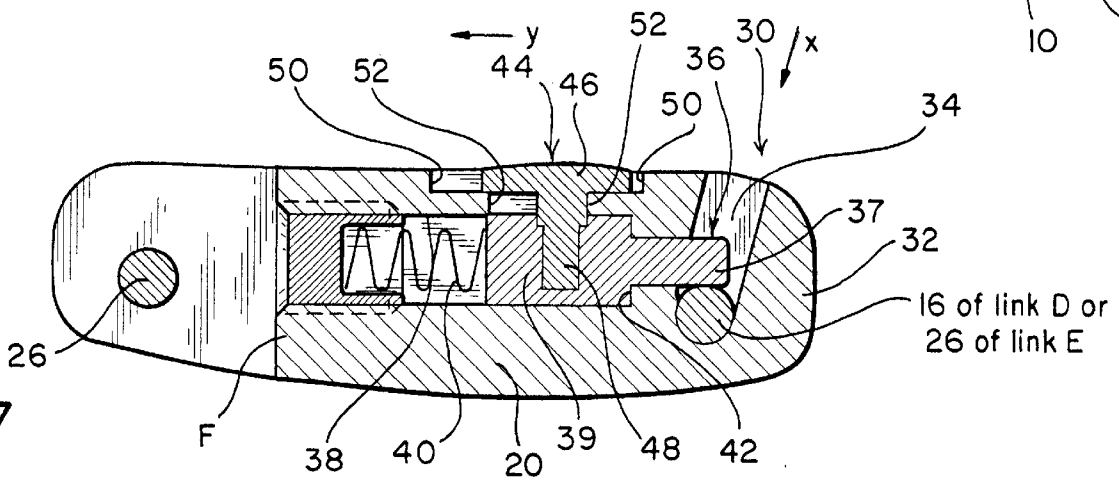
FIG. 3 is a cross-sectional view of a removable link constructed in accordance with the present invention, also illustrating a retainable bar of an adjacent link.

Reference is now made to FIG. 3 which illustrates, from a cross-sectional view, the preferred construction of links E, F and G. Hand portion 30 includes a fingerextending member 32 extending from body 20 so as to form a gap, or bar receiving region 34. Extending into gap 34 is a retractable retaining pin 36. Pin 36 includes a head 37 which extends into gap 34 and a body 39 which is retained in a bore 38 within body 20. Pin 36 is slideable within bore 38 and biased towards gap 34 by a spring member 40. Spring member 40 and pin 36 are inserted through the back of body 20 via a hole formed therein towards the second end thereof. Once pin 36 is inserted into bore 38, spring 40 is inserted behind pin body 39. Spring 40 rests flush to the back of pin body 39, and thus needs no permanent securing thereto, as spring 40 needs only to mate flush to pin body 39 and is kept from moving by the fit within the bore 38. The second end of spring member 40 is trapped in place by a screw retainer pin, or plug, that can fit into body 20 and retains the spring member within the bore. Such a plug is shown in the aforementioned U.S. application Ser. No. 09/627,459 (Docket AO487A), the disclosure of which is incorporated by reference as if fully set forth herein, although forms no material part of the present invention. It is this configuration, a linear bore drilled from the backside of body 20 that allows assembly of the pin body and spring member within the bore and into the link. After this assembly, bar 26 is then driven in place in a known manner. Inner wall surfaces 42 in bore 38 help prevent retaining pin 36 from sliding out of bore 38 or from overextending into gap 34. Pin 36 may be compressed inwardly deeper within bore 38 against the biasing of spring member 40 as described below.

A retractor 44 is provided and coupled to retaining pin 36 for retracting retaining pin 36 away from the gap 34 (in the direction of arrow "y") and deeper within bore 38. In the preferred embodiment, retractor 44 is a one-piece member including a head 46 and a stem 48. Stem 48 of retractor 44 may be secured within pin body 39 by a press fit. However it should be understood that this could be accompanied by glue, loctite, etc., for additional security, and/or even tapping the hole in the pin body. A channel is formed in body 20 having sidewalls 50 and 52 to prevent overcompression of spring 40 and retractor head 46 or stem 48, respectively, within body 20. As seen in FIG. 3, the top surface of head 46 extends above the top surface of body 20 so as to permit a user (such as by using a thumb or index finger or fingernail thereof) to engage retractor 44 and retract it in the direction away from gap 34 (in direction "y"). In this way, pin 36 is biased away from and out of gap 34 as well. However it is also contemplated that a small hole, slot, grooves and/or recess can be added to the top of retractor 44 to allow common items, such as a pen tip, paper clip, coin, screwdriver, etc., to be inserted into the hole, slot, etc. to aid in the ease of activating retractor 44.

In operation, link E or link D (if link E is omitted) or a springbar of a watchhead is releasably secured to link F by sliding bar 26 (i.e. "the retainable bar") downwardly (in the direction of arrow "x") into gap 34 while retractor 44 is biased in the direction of arrow "y" causing pin 36 to be compressed inwardly thereby retracting head 37 of pin 36 out of gap 34. After pin 26 of link E (or pin 16 of link D if link E is absent from consideration) passes below pin 36 in gap 34, retractor 44 may be released thereby causing pin 36 of link F to once again be biased outwardly out of bore 38 towards and into gap 34. In this way, the retainable bar 26 of link E (bar 16 of link D) is retained within gap (bar retaining region) 34 by retaining pin 36 of link F. Retainable bar 26 of link E (bar 16 of link D or springbar of a watchband) is decoupled from removable link F by causing retractor 44 once again to be biased by the user in the direction "y", causing retaining pin 36 to be moved sufficiently out of gap 34 to allow retainable bar 26/16 to be removed from gap 34 in a direction opposite direction "x". In this way, bar 26 of link E is securely, and releasably retained within gap 34 of link F.

In the figures and as stated above, in the preferred embodiment, link G is coined the "decouplable link" because, in the most simple of interlocking link arrangements, link F is entirely removable from watchband 5 while link G is preferably coupled to a non-removable link or a link needing a special tool for removal. For example, bar 26 of link G may be coupled to a link constructed similarly to link C. However, bar 26 of link F must also be releasable from bar retaining region 34 of link G. For this reason, link G includes a hand region, spring member, retaining pin and retractor preferably identical to link F. With link E absent, only one removable link (i.e. "F") is shown in FIG. 2 although the arrangement contemplates more being utilized such as in FIG. 5.

Figure 4:
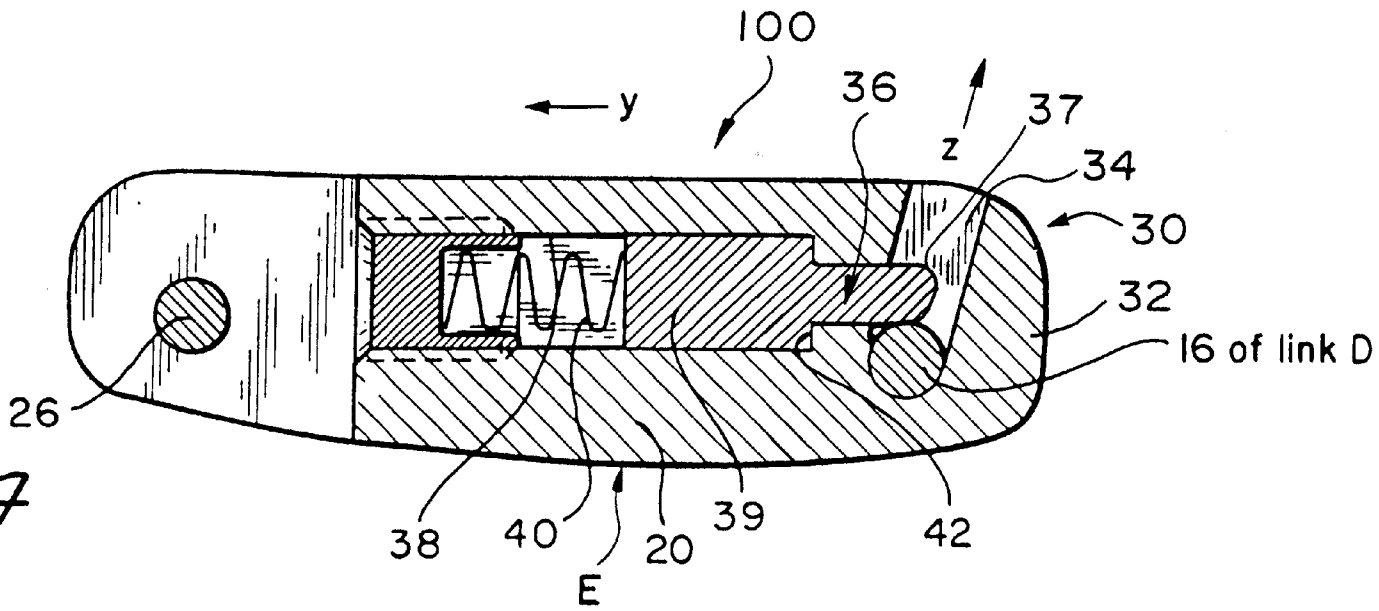
FIG. 4 is a cross-sectional view of a removable link construction which is the subject matter of a copending patent application Ser. No. 09/627,459 (Docket AO487A), the inventor of which is Cheung Yat Fat, the subject matter and the application thereof being owned by the Assignee of the instant invention and application.
Figures 6A, 6B, 6C, 6D:
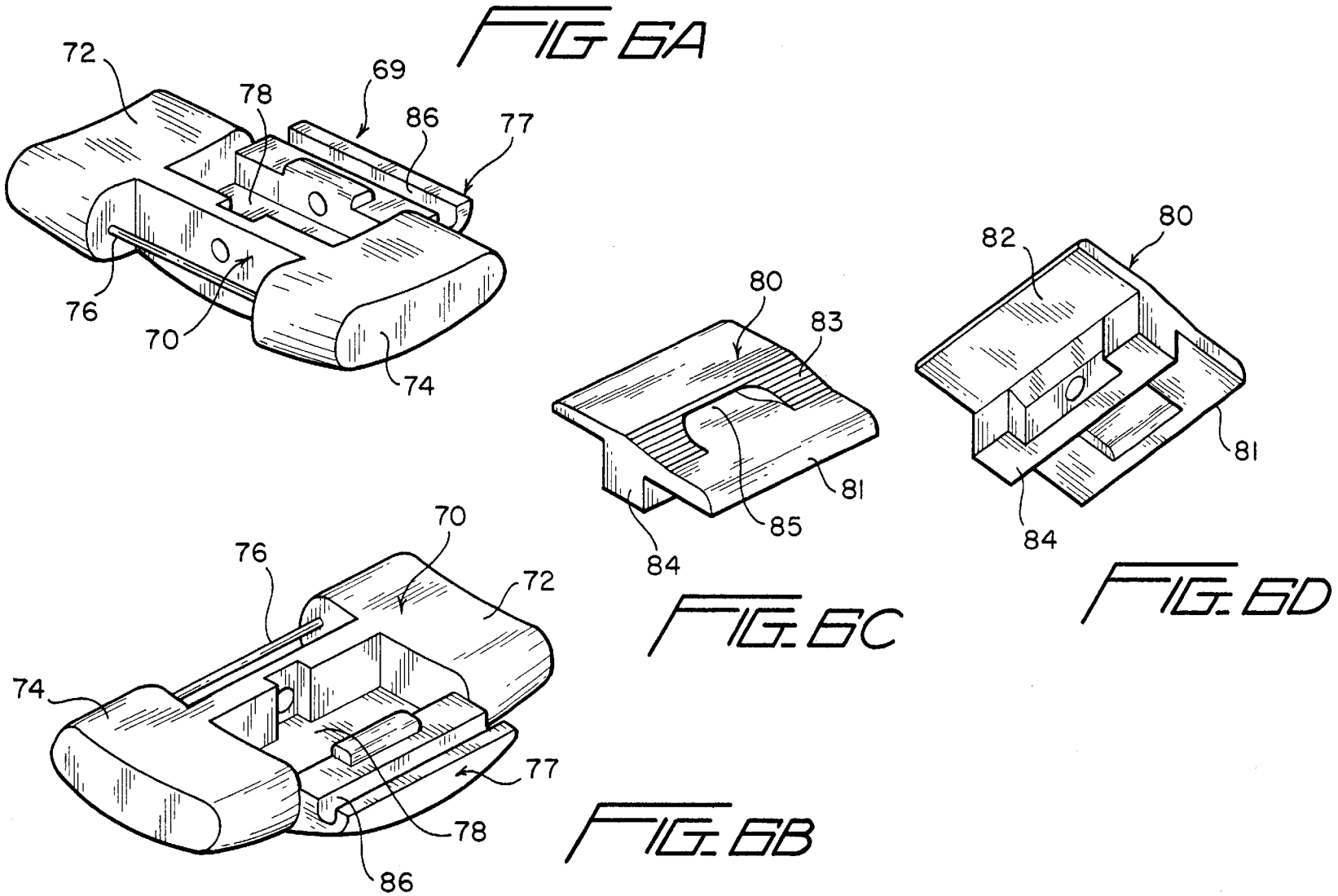
FIGS. 6A and 6B shown a link body of a removable link constructed in accordance with yet another embodiment of the present invention.
FIGS. 6C and 6D show different views of a cover for the removable link of this alternate embodiment.

Reference is very briefly made to FIG. 4 which illustrates a removable link 100, the subject of which is disclosed and claimed in the aforementioned U.S. application Ser. No. 09/627,459 (Docket AO487A). That is, retractor 44 may be eliminated and the appreciation of a more rounded head 37 permits the direct biasing of pin 36 within bore 38. In this construction, force upon pin 36 within and out of gap 34 includes a horizontal component in the "y" direction (and that opposite to the "y" direction) will cause pin 36 to retract within bore 38 in the manner described above, and upon the passing of a bar below or above pin 36, pin 36 will again spring forward into gap 34 by way of the spring member 40 contained within bore 38 of link 100 thus retaining a bar therein. To achieve the forgoing, bar 16 of a link, such as link D (or a springbar of a watchhead) is preferably slidably forced passed the rounded end of head 37 of pin 36 of link 100. Pin 36 is compressed inwardly (in the direction of arrow "y") as bar 16 of link D passes thereby, but is once again biased outwardly into gap 34 once bar 16 has cleared head 37 of pin 36. In this way, bar 16 of link D is securely and yet releasably retained within gap 34 of link 100.

To insert (or decouple) a link into (or from) link 100, the links may be rotated perpendicular relative to each other. By then lightly forcing the links together, pin le will compress so as to allow bar 16 to pass thereby. Upon the clearing of bar 16 passed pin 36, pin 36 will securely retain bar 16 within gap 34. To decouple the links, they may be, but not necessarily, perpendicularly aligned and then rotated clockwise or counterclockwise as illustrated in the aforementioned copending application, thus causing the decoupling of the links, as the pulling action of the links away from each other in the manner described therein causes bar 16 of link D to move out of gap 34 of link 100, first contacting the end of pin 36 and thereby compressing pin 36 so as to allow bar 16 to pass thereby. Upon the clearing of bar 16 relative to pin 36, link D, and all links still coupled thereto, are hence decoupled from link 100. Of course, the links may be decoupled without providing any perpendicular or clockwise/counterclockwise rotation. That is, merely pulling link D out of gap 34 in a direction of arrow "z" would also work.

Figure 5:
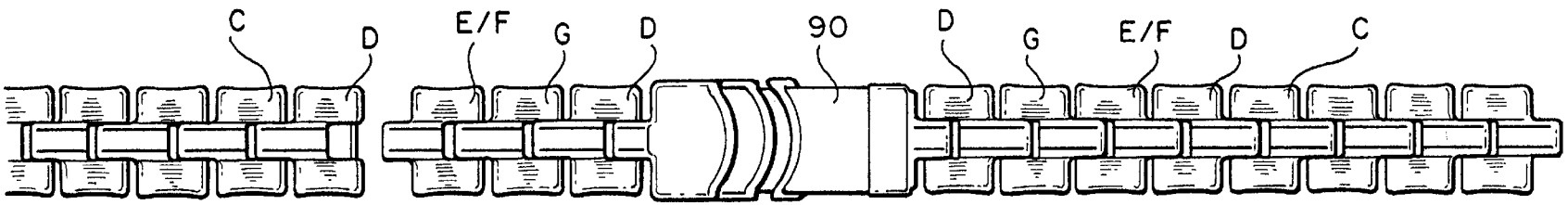
FIG. 5 is a top plan view of the interlocking link arrangement which may be a watchband by way of illustration, and not limitation, constructed in accordance with the present invention, some of the links being detached to more particularly highlight the features, structure and functions thereof.

To summarize the foregoing, reference is now made to FIG. 5 which is a top plan view of watchband 5 more completely assembled and highlighting the aforementioned aspects and features of the present invention. Specifically, watchband 5 is comprised of a plurality of links, not all of which are removable. In particular, not every link need be removable. Such a construction will reduce the manufacturing cost, and is most practical in that no more than a few links ever need to be removed at one time, although a wristband in which every link is removable is within the scope of the invention.

As shown in FIG. 5, links C, D, E, F, and G (and those links respectively identical thereto) are specifically highlighted, as it is shown that it is preferable to have an equal number of removable links on either side of a clasp 90, since for symmetry, it may be desirable to remove an equal number of links on each side of the clasp 90. In the disclosed example, a metal foldover buckle (clasp) 90 is used. A wristband using this type of clasp can easily take advantage of the present invention. Removing only one removable link at a time is easily contemplated hereby. FIG. 5 illustrates how, from the top plan view, it is at least difficult to determine which links are removable. Multiple removable links on either side of clasp 90 is preferred to provide maximum flexibility to a user.

Still further, while the present invention is disclosed most preferably with regard to watchbands, the present invention could also be use for bracelets, necklaces or any other device that could appreciate the adjustability of the interlocking link arrangement of the present invention.

Lastly, FIGS. 6A–D illustrates another removable link 69, constructed in accordance with yet another embodiment of the present invention. Removable link 69 may comprise a body 70 having shoulders 72, 74 with a bar 76 therebetween in a manner similar to links A–G. A hand portion 77 similar to hand portion 30 is provided at one end of body 70. A channel 78 is provided in body 70. Link 69 also includes a slidable cover, generally indicated at 80, having a head 82 and body 84. Body 84 is biased in channel 78 in such a manner that one end 81 of head 82 is positionable over a gap 86 formed in hand portion 77. Cover 80 can be biased by way of a spring member (not shown) so as to cover gap 86 or be removed from overlaying gap 86. In this way, when end 81 is covering gap 86, a retainable bar is securely retained within gap 86 and when it is desired to have the retainable bar (such as from link D or a springbar) removed therefrom, biasing cover 80 away from over gap 86 with a finger or nail thereof will allow the removal of the retainable pin in a manner similar to above. That is, link 69 is actuated by sliding cover 80 rearward along a central shaft (not shown) which compresses the spring. Once in this position link 69 can be simply removed from an adjacent link as the retainable bar is no longer trapped by cover 80. Cover 80 may also include several thin ribs 83 and/or a narrow finger slot 85 on the top surface thereof to facilitate gripping and sliding of the cover rearward. The link mechanism could be housed as a unit, which then would drop into "shell" links to make a modular construction. This would allow for the use of a combination of materials. Also, the shape of the link or cover 80 may have a flange or protrusion which could facilitate in the sliding of cover 80 rearward, thus acting as a "key". An actual "key-type" element may also be included with the invention, or even incorporated into the buckle or strap, to readily aid a user in sliding the cover rearwardly. Link 69 could be used in place of links E or F in FIG. 5 with no loss of functional superiority to the prior art.

While the invention has been particularly shown and described with respect to preferred embodiments thereof, it will be understood by those skilled in the art that changes in form and details may be made therein without departing from the scope and spirit of the invention.

For example, the material of the links is one of design choice and may be comprised of metal, steel, plastic, combinations or forms thereof, and may include brass, stainless steel, alloys, titanium, aluminum, composites, or the like. The spring may be made of varying materials, such as metal, PVC, Silicone, Rubber, etc., formed into a cylindrical shape (or other shape that would be accommodated in the bore, so as to allow more flexibility in the shape of the link) and inserted into the bore as any compressible material trapped in the bore can act as a spring due to the nature of the material.

Also, as end pieces to a watchstrap (such as a leather watchstrap for example) or as attachments to the watchhead (such as to the respective springbars thereof), the present invention provides for added enjoyment as interchangeable watchstraps or watchheads can be used by merely "linking" up each other as disclosed herein. That is, the present invention need not be used with a decouplable link since it would be used more as a clip than a removable link. That is, the link could be incorporated at the ends of a strap, such as a leather strap whose end is wrapped and secured (by stitching for example) around the bar of the link as would be understood in the art, and then just clipped onto the watchhead, such as the springbars thereof. Likewise, the link may depend from the watchhead (from the springbar, for example, or molded to the watchhead) and clipped on to the ends of a watchstrap (i.e. the watchstrap would have the retainable bar secured thereto, such as by stitching or other known method). In this way, an economical and easy way to provide for interchangeable straps and/or watchheads is provided. It is therefore also possible to construct the present invention so as to have the aforementioned hand portion at each end of the link for securing the watchhead to the watchstrap. The embodiment of FIG. 4 may also be used in the manner set forth herein.

What we claim is:

1. A watchband, the watchband comprising:

a plurality of interlocking links, wherein at least one of the interlocking links is a removable link and at least one of the interlocking links is a decoupling link;

wherein the at least one removable link comprises:

a link body having a first end and a second end;

a hand portion having a bar receiving region formed at the first end of the body; a bar coupled to the second end of the body; a retractable retaining pin having a first end within the link body and a second end extending from the link body into the bar receiving region, the retractable retaining pin being slideable within a bore provided in the link body, the retaining pin for retaining a retainable bar in the bar receiving region; a biasing member, coupled to the retaining pin, for biasing the retaining pin towards the bar receiving region; and a retractor, coupled to the retaining pin, for retracting the retaining pin away from the bar receiving region; and wherein the at least one decoupling link that is decouplable from the removable link comprises:

a link body having a first end and a second end;

a hand portion having a bar receiving region formed at the first end of the body; a retractable retaining pin having a first end within the link body and a second end extending from the link body into the bar receiving region, the retractable retaining pin being slideable within a bore provided in the link body, the retaining pin for retaining the bar of the removable link in its bar receiving region; a biasing member, coupled to the retaining pin, for biasing the retaining pin towards the bar receiving region; and a retractor, coupled to the retaining pin, for retracting the retaining pin away from the bar receiving region;

whereby the first end of the removable link is decoupled from the watchband by causing the retainable bar to be decoupled from the removable link by retracting the retaining pin of the removable link away from the bar receiving region sufficiently to allow the retainable bar to be removed from the bar receiving region of the removable link, and further whereby the second end of the removable link is decoupled from the decoupling link by causing the retracting of the retaining pin of the decoupling link away from the bar receiving region of the decoupling link sufficiently to allow the bar of the removable link to be removed therefrom.

2. The watchband as claimed in claim 1, including a plurality of removable links.

3. The watchband as claimed in claim 1, wherein the link body of the removable link comprises integrally formed, spaced apart first and second shoulders;

wherein the bar of the removable link is secured to and between the first and second shoulders.

4. The watchband as claimed in claim 1, wherein the biasing member of the removable link is a spring.

5. The watchband as claimed in claim 1, wherein the retainable bar is coupled to another one of the plurality of interlocking links.

6. The watchband as claimed in claim 1, wherein the retainable bar is a springbar coupled between a pair of lugs which themselves are part of a watch casing.

7. The watchband as claimed in claim 1, wherein the link body of the removable link comprises a channel on one side thereof and the retractor includes a stem and an integrally formed head;

wherein the channel includes sidewalls to restrict the slidability of the retractor therein.

8. The watchband as claimed in claim 7, wherein the retaining pin of the removable link includes a pin body; and the stem of the retractor is secured within the pin body.

9. The watchband as claimed in claim 1, wherein the link body of the removable link includes inner wall surfaces to prevent the retaining pin thereof from overextending within the bar retaining region of the removable link.

10. A watchband comprising:

a plurality of interlocking links, wherein the plurality of interlocking links includes at least one removable link that is decouplable from a decoupling link, wherein the removable link comprises:

a link body having a first end and a second end;

a hand portion having a bar receiving region formed at the first end of the body;

a retractable retaining pin having a first end within the link body and a second end extending from the link body into the bar receiving region, the retractable retaining pin being slideable within a bore provided in the link body, the retaining pin for retaining a retainable bar in the bar receiving region;

a biasing member, coupled to the retaining pin, for biasing the retaining pin towards the bar receiving region; and a retractor, coupled to the retaining pin, for retracting the retaining pin away from the bar receiving region;

whereby the retainable bar is retained within the bar receiving region by the retaining pin, and whereby the retainable bar is decoupled from the removable link by retracting the retaining pin away from the bar receiving region sufficiently to allow the retainable bar to be removed therefrom.

11. A method of reducing the length of a watchband, wherein the watchband comprises a plurality of interlocking links, at least one of which is a removable link and another of which is a decoupling link;

wherein the removable link comprises a link body having a first end and a second end; a hand portion having a bar receiving region formed at the first end of the body; a bar coupled to the second end of the body; a retractable retaining pin, extending from the link body into the bar receiving region, for retaining a retainable bar in the bar receiving region; a biasing member, coupled to the retaining pin, for biasing the retaining pin towards the bar receiving region; and a retractor, coupled to the retaining pin, for retracting the retaining pin away from the bar receiving region; and wherein the at least one decoupling link that is decouplable from the removable link comprises a link body having a first end and a second end; a hand portion having a bar receiving region formed at the first end of the body; a retractable retaining pin, extending from the link body into the bar receiving region, for retaining the bar of the removable link in its bar receiving region; a biasing member, coupled to the retaining pin, for biasing the retaining pin towards the bar receiving region; and a retractor, coupled to the retaining pin, for retracting the retaining pin away from the bar receiving region;

wherein the method comprises the steps of:

removing a first retainable bar from the bar receiving portion of the removable link by retracting the retaining pin of the removable link away from the bar receiving region of the removable link sufficiently to allow the retainable bar to be removed therefrom;

decoupling the second end of the removable link from the decoupling link by retracting the retaining pin of the decoupling link away from the bar receiving region of the decoupling link sufficiently to allow the bar of the removable link to be removed therefrom; and coupling the retainable bar to the decoupling link by the steps of:

placing the first retainable bar into the bar receiving region of the decoupling link while the retractable retaining pin of the decoupling link is sufficiently retracted so as to allow the retainable bar to be placed into the bar receiving region of the decoupling link; and releasing the retractable retaining pin of the decoupling link while the retainable bar is within the bar receiving region of the decoupling link.

* * * * *